United States Patent [19]

Frisk

[11] 4,249,730

[45] Feb. 10, 1981

[54] TENNIS BALL COMPRISING A HOLLOW SPHERE OF A RUBBER CONTAINING FILLER

[75] Inventor: Lennart J. F. Frisk, Helsingborg, Sweden

[73] Assignee: Tretorn Aktiebolag, Helsingborg, Sweden

[21] Appl. No.: 943,780

[22] Filed: Sep. 20, 1978

Related U.S. Application Data

[63] Continuation-in-part of Ser. No. 770,405, Feb. 22, 1977, abandoned.

[30] Foreign Application Priority Data

Mar. 3, 1976 [SE] Sweden ..... 7602979

[51] Int. Cl.[3] ..... A63B 39/02; A63B 41/02

[52] U.S. Cl. ..... 273/61 C; 273/58 J; 273/DIG. 20

[58] Field of Search ..... 273/61 D, 65 EE, 61 C, 273/58 J, 61 R; 119/29.5

[56] References Cited

U.S. PATENT DOCUMENTS

| | | | |
|---|---|---|---|
| 1,149,170 | 10/1915 | Allis | 119/29.5 |
| 2,295,815 | 9/1942 | Webb | 273/65 EE |
| 3,123,047 | 3/1964 | Fisher | 119/29.5 |
| 3,198,173 | 8/1965 | Fisher | 119/29.5 X |

FOREIGN PATENT DOCUMENTS

| | | | |
|---|---|---|---|
| 617664 | 9/1949 | United Kingdom | 273/61 D |

*Primary Examiner*—George J. Marlo

[57] ABSTRACT

A tennis ball is provided comprising a hollow sphere of natural rubber and/or synthetic rubber similar in resilience properties to natural rubber, said rubber containing a filler, said sphere containing a gas having the same or higher pressure than that of the surrounding atmosphere, said filler comprising chrome-tanned leather particles, all of the dimensions of which being within the range of 0.1–2.50 mm.

2 Claims, No Drawings

TENNIS BALL COMPRISING A HOLLOW SPHERE OF A RUBBER CONTAINING FILLER

This application is a continuation-in-part of application Ser. No. 770,405, filed Feb. 22, 1977, now abandoned.

The present invention relates to playballs, in particular tennis balls. A playball usually consists of a hollow sphere made of an elastic material which is usually a composition of rubber or rubber-like material suitably composied to give properties appropriate to the playball. In case the hollow sphere, hereinafter called the playball shell, contains a gas at a pressure above that of the atmosphere the ball is called a pressure ball. In case the hollow sphere contains a gas, such as air, having the same pressure as that of the atmosphere, the ball is called a pressureless ball. The playball according to the invention may either be a pressureless ball or a pressure ball.

It will be appreciated that the above remarks apply to a tennis ball, which may be regarded as a particular type of playball in which the surface is covered with a textile medium composed of natural and/or synthetic fibres in an arrangement whereby the particular desirable playing properties of a tennis ball are achieved.

Many attempts have been made to improve the properties of balls. In such attempts it has often been possible to improve a certain property of the ball, but usually any of the remaining properties of the ball has become deteriorated. The present invention provides a ball exhibiting a unique combination of properties. This combination comprises a better bouncing ability, a great hardness and an improved tear strength. No such combination of properties is previously known.

The Swedish patent specification No. 140,283 discloses a ball, for example a tennis ball, which consists of a shell of a rubber composition, which contains a butadiene-styrene resin as a filler. As will appear from the description below, this ball does not exhibit the valuable properties of the ball according to the present invention.

An object of the present invention is the preparation of tennis balls having a great hardness, a great tear strength and especially an improved bouncing ability.

This object of the invention as achieved by formulating the playball shell from a rubber composition comprising natural rubber and/or synthetic rubber similar in resilience properties to natural rubber, and a filler, the filler comprising chrome-tanned leather particles.

Thus, the invention provides a tennis ball comprising a hollow sphere of natural rubber and/or synthetic rubber similar in resilience properties to natural rubber, said rubber containing a filler, said sphere containing a gas having the same or higher pressure than that of the surrounding atmosphere, wherein said filler comprises chrome-tanned leather particles all having dimensions within the range of 0.1–2.5 mm.

The sphere consists of a vulcanized mixture based on natural rubber and/or synthetic rubber, for example cis-polyisoprene, methacrylate rubber or cis-polybutadiene. Compounding ingredients such as vulcanization agents and accelerators may be added, if rwquired.

The chrome-tanned leather present in the rubber composition is in a particulate or comminuted form. This is achieved by for example grinding to such an extent that all dimensions of the particles are within the range of 0.1–2.5 mm. The leather particles of the invention shall not be confused with leather dust or leather flour which is of substantially less dimensions. Prior to admixture into the rubber composition the chrome-tanned leather particles have preferably a moisture content of less than 1%. The amount of filler in the composition is not critical. However, it has turned out that a filler content of 5–45 percent by weight of the amount of rubber present in the composition is a preferable range. The leather has preferably a density of 1.47 g/cm$^3$. The effect of the chrome-tanned leather particles can be further improved by addition of a vegetable oil, such as rape-seed oil, and/or a mineral oil.

The invention is illustrated in the following examples, in which all parts are parts by weight.

EXAMPLES

Satisfactory balls having zero super-atmospheric internal pressure were prepared from the compositions defined in Table 1 below.

Examples 3 and 7 are control examples, according to which butadiene-styrene resin is included in the composition, Example 3 containing no leather and Example 7 containing leather and butadiene-styrene resin. The chrome-tanned leather present in the compositions defined in Table 1 has been obtained by shaving of hides of chrome-tanned leather, which has been dried to a moisture content of about 1 percent and has been finely divided by grinding to a particulate form.

Half-shells were made from the compositions having a wall thickness of about 4.2 mm and spherical playball shells were formed by moulding the shells at the temperature and during the time period defined in Table 2 below, which vulcanized the compositions. The spherical shells were then made into tennis balls by applying conventional tennis ball felt covering and were then vulcanized and treated in a conventional manner. Prior to the preparation of the balls the compositions were tested with regard to hardness, elongation, tear strength and density. The resulting tennis balls were tested with regard to their bouncing capacity. The results obtained appear from Table 2 below.

TABLE 1

| | EXAMPLE | | | | | | |
|---|---|---|---|---|---|---|---|
| COMPONENT | 1 | 2 | 3 | 4 | 5 | 6 | 7 |
| Methacrylate rubber "Heveaplus MG 49" | — | — | — | 40.00 | 30.00 | 30.00 | — |
| Natural rubber | 100.00 | 62.50 | 62.50 | 80.00 | 65.00 | — | 100.00 |
| Isoprene rubber (cis-polyisoprene) | — | — | — | — | — | 65.00 | — |
| Cis-polybutadiene rubber | — | 37.50 | 37.50 | — | 20.00 | 20.00 | — |
| Butadiene-styrene resin | — | — | 26.63 | — | — | — | 15.00 |
| Particulate chrome-tanned leather | 31.25 | 31.25 | — | 20.00 | 20.00 | 20.00 | 20.00 |
| Vulcanizing agent | 2.00–10.00 | 2.00–10.00 | 2.00–10.00 | 2.00–10.00 | 2.00–10.00 | 2.00–10.00 | 2.00–10.00 |

TABLE 1-continued

| COMPONENT | EXAMPLE 1 | 2 | 3 | 4 | 5 | 6 | 7 |
|---|---|---|---|---|---|---|---|
| Stearine | 1.75 | 1.75 | 1.75 | 1.75 | 1.75 | 1.75 | 1.75 |
| Antioxidant | 0.80 | 0.80 | 0.80 | 0.80 | 0.80 | 0.80 | 0.80 |
| Accelerators | 2.00–4.00 | 2.00–4.00 | 2.00–4.00 | 2.00–4.00 | 2.00–4.00 | 2.00–4.00 | 2.00–4.00 |
| Sulphur | 2.50–5.00 | 2.50–5.00 | 2.50–5.00 | 2.50–5.00 | 2.50–5.00 | 2.50–5.00 | 2.50–5.00 |

TABLE 2

Testing results from compositions for raw balls
Composition according to example

| Property | Vulcanizing time, min. at 140° C. | 1 | 2 | 3 | 4 | 5 | 6 | 7 |
|---|---|---|---|---|---|---|---|---|
| Hardness Shore A according to SIS 162201 | 5 | 82 | 80 | 70 | 82 | 79 | 80 | — |
| | 10 | 83 | 79 | 71 | 82 | 80 | 81 | — |
| | 20 | 82 | 78 | 71 | 82 | 80 | 81 | 78 |
| | 40 | 80 | 78 | 70 | 80 | 81 | 81 | — |
| Elongation % according to SIS 162202 | 5 | 240 | 125 | 370 | 280 | 265 | 250 | |
| | 10 | 155 | 90 | 290 | 190 | 190 | 210 | |
| | 20 | 135 | 105 | 190 | 225 | 160 | 160 | 345.0 |
| | 40 | 270 | 95 | 160 | 220 | 175 | 170 | |
| Tear Strength N according to SIS 162203 | 5 | 89.6 | 76.5 | 48.0 | 145.8 | 102.4 | 102 | |
| | 10 | 84.4 | 76.6 | 48.5 | 117.0 | 82.5 | 81.5 | |
| | 20 | 80.4 | 69.2 | 39.9 | 88.5 | 66.5 | 81.4 | 78.8 |
| | 40 | 83.6 | 73.5 | 37.7 | 89.6 | 84.9 | 81.7 | |
| Density, g/cm$^3$ | | 1.06 | 1.06 | 1.02 | 1.06 | 1.05 | 1.08 | 1.03 |
| Resulting ball Rebound at 20° C. 60 percent relative humidity dropped from a height of 100 inches, cm | | 141–142 | 143–144 | 135–136 | 136–139 | 138–140 | | |

SIS = the Swedish Standards Association

It clearly appears from Table 2 that the balls according to the present invention exhibit greater hardness, greater tear strength and an improved bouncing ability in comparison to balls previously known, such as exemplified in Examples 3 and 7. According to the present invention it has been possible to achieve the unique combination of properties comprising great hardness and great tear strength. Another important advantage of the balls according to the invention is the fact that by using chrome-tanned leather as a filler the resulting ball will not be so sensitive to changes in the climate. A further advantage is the fact that the polishing of the ball before the felt is applied provides a rough surface on which the felt can be more easily attached.

The chrome-tanned leather present in the compositions from which the balls according to the invention can be made, may have the following exemplary composition: water 14.0 percent, ash (without $Cr_2O_3$) 2.0 percent, fat 4.7 percent, hide substance 73.0 percent, bonded tanning material ($Cr_2O_3$) 5.5 percent.

What I claim is:

1. A tennis ball comprising: a hollow sphere of natural rubber and/or synthetic rubber similar in resilience properties to natural rubber and a felt cover completely jacketing said hollow sphere, said rubber containing a filler, said sphere containing a gas having the same or higher pressure than that of the surrounding atmosphere, and said filler comprising chrome-tanned leather particles having all dimensions within the range of 0.1–2.5 mm.

2. A ball according to claim 1, wherein said filler is present in an amount of 5–45 percent by weight of the amount of rubber.

* * * * *